United States Patent [19]

Ridenour

[11] Patent Number: 4,989,791

[45] Date of Patent: Feb. 5, 1991

[54] VALVE NOZZLE ASSEMBLY

[76] Inventor: Ralph G. Ridenour, 626 Lexington-Ontario Rd., Rte. 12, Mansfield, Ohio 44906

[21] Appl. No.: 464,628

[22] Filed: Jan. 3, 1990

Related U.S. Application Data

[63] Continuation of Ser. No. 214,611, Jul. 1, 1988, abandoned, which is a continuation-in-part of Ser. No. 111,258, Oct. 22, 1987, abandoned.

[51] Int. Cl.[5] ..... B05B 1/32

[52] U.S. Cl. ..... 239/579; 239/590.3; 251/352

[58] Field of Search ..... 239/569, 579, 581.1, 239/590.3, 591, DIG. 4, 587; 251/292, 339, 349, 350, 352

[56] References Cited

U.S. PATENT DOCUMENTS

| | | | |
|---|---|---|---|
| 1,895,307 | 1/1933 | Beck | 239/499 |
| 1,914,736 | 6/1933 | Coutu | 251/352 |
| 3,855,640 | 12/1974 | Filliung | 251/352 |
| 4,360,160 | 11/1982 | Jette | 239/587 |
| 4,568,027 | 2/1986 | Lazarus | 239/590.3 |
| 4,591,098 | 5/1986 | Ridenour | 239/288.3 |

FOREIGN PATENT DOCUMENTS

| | | | |
|---|---|---|---|
| 16014 | 5/1881 | Fed. Rep. of Germany | 251/352 |
| 888359 | 12/1943 | France | 251/352 |
| 28359 | 3/1981 | Japan | 251/352 |

*Primary Examiner*—Andres Kashnikow

*Attorney, Agent, or Firm*—Pearne, Gordon, McCoy & Granger

[57] ABSTRACT

An adjustable valve nozzle assembly is provided wherein a partially circular male body is disposed in a socket of a female body so that conduits in each of the bodies may be in fluid communication. A nozzle is mounted in the male body, with the fluid inlet being in the female body. A gasket is provided in the female body for sealing between the socket and the partially circular male body. The socket has an adjustment opening larger than and receiving an extending neck on the male body for permitting angular adjustment of the nozzle in all directions, and a slot extends along a diametral plane from the opening in the socket to form a keyhole-shaped slotted aperture to receive the neck and for permitting the nozzle to be rotated at least about 45 degrees relative to the female body for a shut-off or trickle-flow condition of the valve nozzle assembly. The foregoing abstract is merely a resume of one general application, is not a complete discussion of all principles of operation or applications, and is not to be construed as a limitation on the scope of the claimed subject matter.

25 Claims, 4 Drawing Sheets

VALVE NOZZLE ASSEMBLY

This is a continuation of application Ser. No. 07/214,611, filed on Jul. 1, 1988, now abandoned, which is a continuation-in-part of application Ser. No. 07/111,258, filed Oct. 22, 1987, now abandoned.

BACKGROUND OF THE INVENTION

The prior art has disclosed various ball valves to provide a swiveling action between an open and a closed condition. The prior art has also disclosed water shower spray heads which are adjustable with a ball and socket joint and which include a separate transverse valve to substantially shut off the water flow for a water saving condition. The prior art also has used spray nozzles or misting nozzles to achieve a spray of tiny droplets of water used on refrigerated produce display counters in grocery stores, for example. Such misting nozzles typically have utilized a timer to spray the produce for a short time, and then be off for a long period of time. The typical misting nozzle is slightly adjustable in angular direction in order to more effectively spray the produce as it is displayed on the shelf of the refrigerated display case. Since different produce is often displayed at different times on the same shelves or different portions of the shelves, some produce requires periodic water misting and other produce for sale requires no misting. In the latter case, a separate shut-off valve is required, for example, as shown in U.S. Pat. No. 2,625,806, in order to be able to selectively turn off any water mist on those vegetables which need not or should not be sprayed. U.S. Pat. No. 4,179,900 also shows separate valves for selecting which misting nozzles would be operative at any given times controlled by a timer.

SUMMARY OF THE INVENTION

The problem to be solved, therefore, is how to construct an adjustable nozzle assembly which avoids the prior art construction of individual nozzles and individual shut-off valves for each nozzle.

The problem is solved by a valve nozzle assembly comprising, in combination, a female body having a first longitudinal axis and a generally longitudinal first conduit, a male body having a second longitudinal axis and a generally longitudinal second conduit, a socket in said female body, a substantially circular cross section on said male body for cooperation with said socket, with said first and second conduits adapted to be in communication, said male body having a narrow neck adjacent said socket, a nozzle mounted in one of said bodies, gasket means in the other of said bodies and surrounding the conduit therein for sealing between said socket and said circular cross section male body, said narrow neck having a first transverse dimension, said socket having an opening larger than and receiving said neck for permitting angular adjustment of said nozzle in the order of 20 degrees relative to said first longitudinal axis, and a slot in said socket extending along a diametral plane and merging with said larger socket opening to form a keyhole-shaped slotted opening with said slot having a width sufficient to receive said neck for permitting said nozzle to be rotated at least 45 degrees between first and second positions whereat said first conduit in one of said positions is substantially sealed from communication with said second conduit by said gasket means for a shut-off valve or trickle-flow condition of said valve nozzle assembly.

The problem is further solved by a nozzle assembly having a partially circular male body in a socket of a female body so that conduits in each of said bodies may be in fluid communication, a nozzle mounted in one of said bodies, gasket means in the other body for sealing between the socket and the male body, and said socket having an adjustment opening larger than and receiving an extending neck on said male body for permitting angular adjustment of said nozzle in the order of 20 degrees relative to the axis of said female body, characterized in that a slot is provided in said socket extending along a diametral plane and merging with said adjustment opening to form a keyhole-shaped slotted opening with said slot having a width sufficient to receive said neck for permitting said nozzle to be rotated at least 45 degrees relative to said other of said bodies between first and second positions, said first position establishing said conduits substantially sealed from communication by said gasket for no more than a trickle-flow condition of said nozzle assembly, and said second position being with said neck in said socket adjustment opening for establishing substantially full fluid flow throughout said angular adjustment of said nozzle in the order of 20 degrees relative to the axis of said female body.

Accordingly, an object of the invention is to provide an adjustable nozzle assembly which incorporates its own shut-off valve without additional parts.

Another object of the invention is to provide a ball and socket for adjustment of a nozzle outlet, and with the ball and socket additionally providing a shut-off or substantial shut-off valve of the nozzle assembly.

Other objects and a fuller understanding of the invention may be had by referring to the following description and claims, taken in conjunction with the accompanying drawing.

DESCRIPTION OF THE PREFERRED EMBODIMENTS

Figure 1:
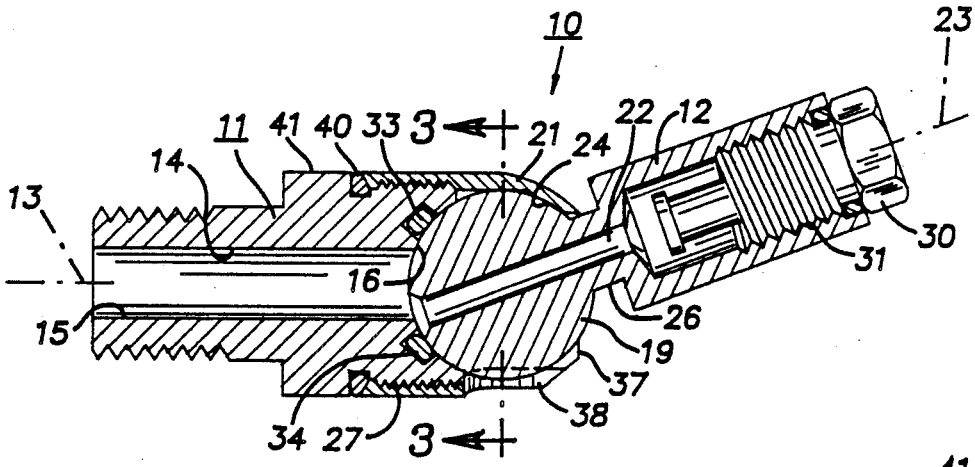
FIG. 1 is a longitudinal sectional view of a nozzle assembly showing the present invention.
Figure 3:
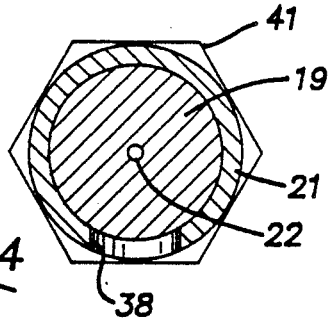
FIG. 3 is a sectional view on line 3—3 of FIG. 1.

The drawing FIGS. 1-4 illustrate a nozzle assembly 10 which includes generally a female body 11 and a male body 12. The female body 11 has a first longitudinal axis 13 and a longitudinal first conduit 14 extending through the length of this body from an inlet 15 to a socket 16. The socket 16 has a partially circular cross section, as shown in FIG. 1, and in the preferred embodiment this is a partially spherical surface.

The male body 12 has a substantially circular cross section 19, and in the preferred embodiment, this is a partial ball adapted for cooperation with the socket 16. The socket 16 is formed from two pieces, a part of the female body 11, and a retainer 21. The retainer 21 secures the male body 12 in the socket 16 in a position so that a second conduit 22 in the male body is adapted to be in communication with the first conduit 14. The second conduit 22 lies generally along a second longitudinal axis 23 of the male body 12. In this embodiment, the retainer 21 is in the form of a cap having a partially spherical socket surface 24 to engage the ball 19 near a narrow neck 26 and hold it in the two-piece socket by threaded engagement at 27 with the female body 11.

A nozzle, such as a misting nozzle 30, is secured in one of the bodies, and in the preferred embodiment it is secured in the male body 12 by threads 31, and is designed to produce a mist of fine droplets of water, e.g., to provide a fine spray or mist over refrigerated produce in a display case. Gasket means, such as a gasket 33, is provided in the other of the bodies, and in this embodiment this is provided in the female body 11. This gasket is preferably an O-ring supplied in an annular groove 34. This O-ring surrounds the first longitudinal conduit 14 and seals between the ball 19 and socket 16. The retainer cap 21 has a generally circular adjustment opening 37 which is larger than and receives the neck 26 and, being larger, permits angular adjustment of the nozzle 30 and second longitudinal axis 23 relative to the first longitudinal axis 13. In this embodiment, this may be an angular adjustment of a preset number of degrees such as 20 degrees in all directions relative to the axis 13.

FIG. 1 shows this adjustment of the male body 12 in its greatest extent in an upward direction and still with full fluid flow. The retainer cap 21 is also provided with a narrow slot 38 (see FIGS. 3 and 4) which extends along a diametral plane from the socket and merges with the enlarged opening 37, and thus forms a recess such as a keyhole-shaped slotted opening (see FIG. 4). This slot in the retainer cap extends around a part of the circumference of the partially spherical surface 24 so that the male body 12 may be rotated into a first position shown in FIG. 2, as well as rotated into a second position shown generally in FIG. 1.

Figure 2:
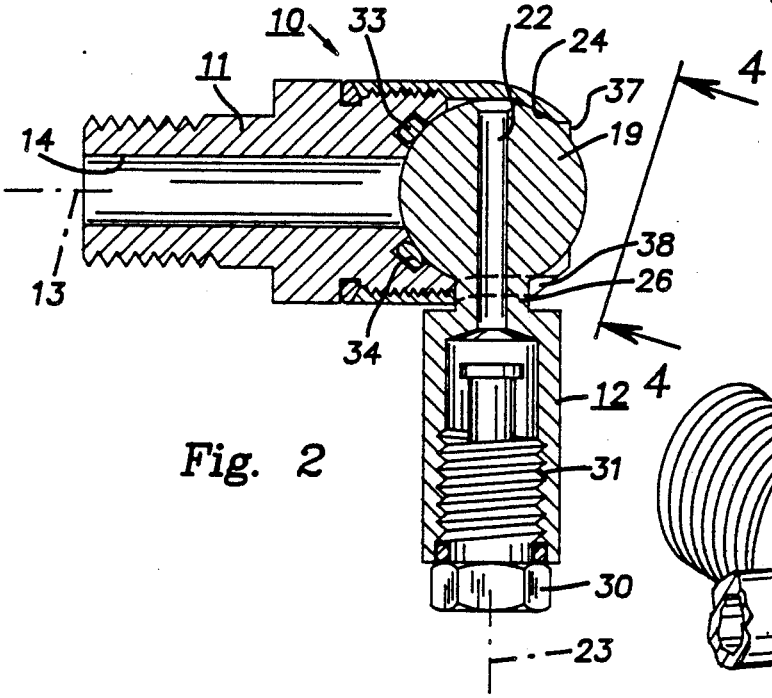
FIG. 2 is a longitudinal sectional view of the nozzle assembly of FIG. 1 in a shut-off position.

In the first position shown in FIG. 2, this establishes the conduits 14 and 22 sealed from communication with each other by the O-ring 33 for a shut-off valve condition of the nozzle assembly 10. The second position shown generally in FIG. 1 permits full fluid communication between the conduits 14 and 22 so that water in the inlet 15 may be sprayed as a fine mist from the nozzle 30. It will be noted from FIG. 1 and FIG. 2 that the male body 12 need be rotated only about 55 degrees from the first longitudinal axis 13 in order to have the conduit 22 disposed outside the annulus of the O-ring 33, and hence be in a shut-off position. If it is rotated about 50 degrees, the gasket 33 will close off most of the flow for a substantially shut-off condition, if desired.

Further as shown in FIG. 2, the construction is such that the male body 12 may be rotated a full 90 degrees relative to the first longitudinal axis 13 to assure a positive shut-off valve condition.

In this embodiment, the retainer 21 is a threaded cap and an additional O-ring 40 is disposed at the end of the cap adjacent a hex wrench pad 41 on the female body 11. The O-ring 40 provides additional sealing, and also provides friction to restrain unthreading movement of the cap 21.

Figure 6:
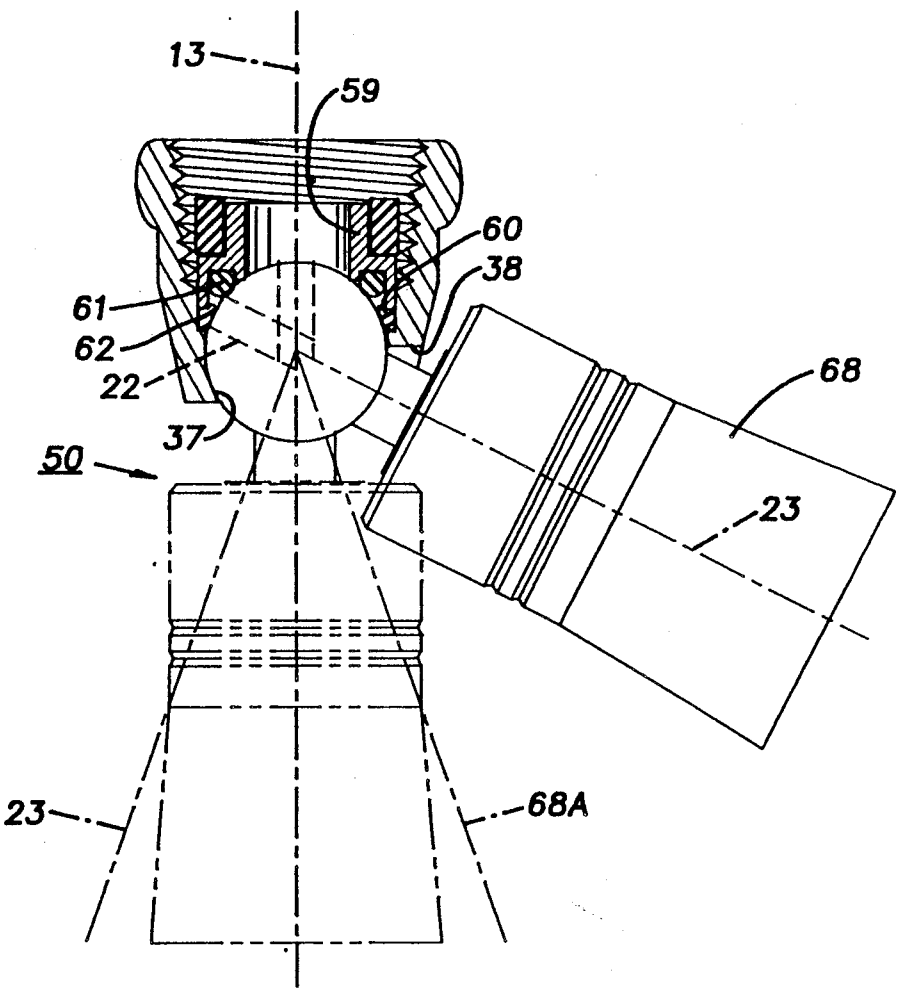
FIG. 6 is a side view of the embodiment of FIG. 5.
Figure 5:
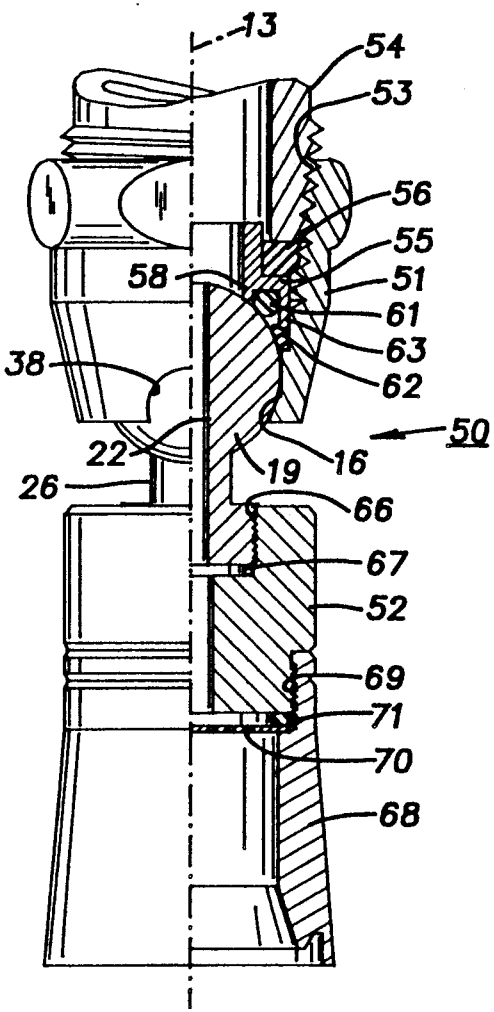
FIG. 5 is a plan view, partly in longitudinal section, of a second embodiment of the invention.

FIGS. 5 and 6 show a second embodiment of the invention, of a valve nozzle assembly 50, with a female body 51 and a male body 52. The female body has the first longitudinal axis 13 and the second body has the second longitudinal axis 23. The female body 51 has a threaded inlet 53, shown threaded around a supply conduit 54, such as a water pipe. The male body 52 has a substantially circular cross section, shown as a ball 19 disposed within the socket 16. Again, this socket 16 is of two-piece construction, and in this case the female body 51 forms the front part of the socket and the rear part is formed by an insert 55. The aforementioned parts 51, 52, and 55 are preferably formed of metal, such as brass or chrome-plated brass, for good machining characteristics and long life. A rectangular cross section gasket 56 is used to seal fluid flow against the end of the supply conduit 54 because this may not be a carefully machined surface. The metal insert 55 has an annular extension 58 adjacent an internal conduit 59, which defines part of a recess 60 containing an O-ring 61 as part of the gasket means. Another part of the gasket means is an O-ring 62 of slightly larger diameter and adapted to be compressed partly against the ball 19 and partly against a shoulder on the female body 51 by an extension 63 of the insert 55.

The male body 52 has the second conduit 22 and the narrow neck 26 of the previous embodiment. The neck 26 has a threaded connection at 66, with the male body 52, and sealed by an O-ring 67. The male body 52 in this embodiment forms a spray head or shower head with an extension 68 threaded at 69 to the male body 52, and with a perforated plate 70 sealed by an O-ring 71. The perforated plate 70 has apertures off the axis 23. This may be 10 or 12 small apertures lying on a reference circle coaxial with the axis 23 but displaced therefrom. This construction produces a spray head or shower head with aerated water similar to that in U.S. Pat. No. 4,591,098.

Figure 4:
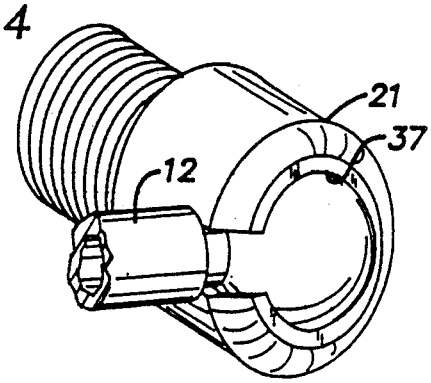
FIG. 4 is a sectional view on line 4—4 of FIG. 2.

The socket 16 has the enlarged adjustment opening 37 of the first embodiment, and the narrow slot 38 which merges with this adjustment opening to form the slotted opening of substantially keyhole shape as shown in FIG. 4. When the narrow neck 26 is within the enlarged adjustment opening 37, the nozzle extension 68 may be adjusted plus or minus 20 degrees relative to the axis 23 and still retain full fluid flow through the conduit 22. Adjustment more than 20 degrees into the slot 38 begins to restrict the flow of fluid as the conduit 22 is progressively blocked by the O-ring 61. Since the diameter of the second conduit 22 is larger than the compressed width of the O-ring 61, the second O-ring 62 comes into use to prevent leakage as the nozzle extension 68 is moved into a first position shown in solid lines in FIG. 6. In this first position, the second conduit 22 is sealed from fluid communication by the two O-rings. If the slot 38 is not quite as deep, then there may be a trickle-flow condition before a substantially shut off condition. With the nozzle extension 68 in the position 68A shown in phantom in FIG. 6, this may be a second position at which the nozzle may be adjusted plus or minus 20 degrees in all directions relative to the axis 13.

Figure 7:
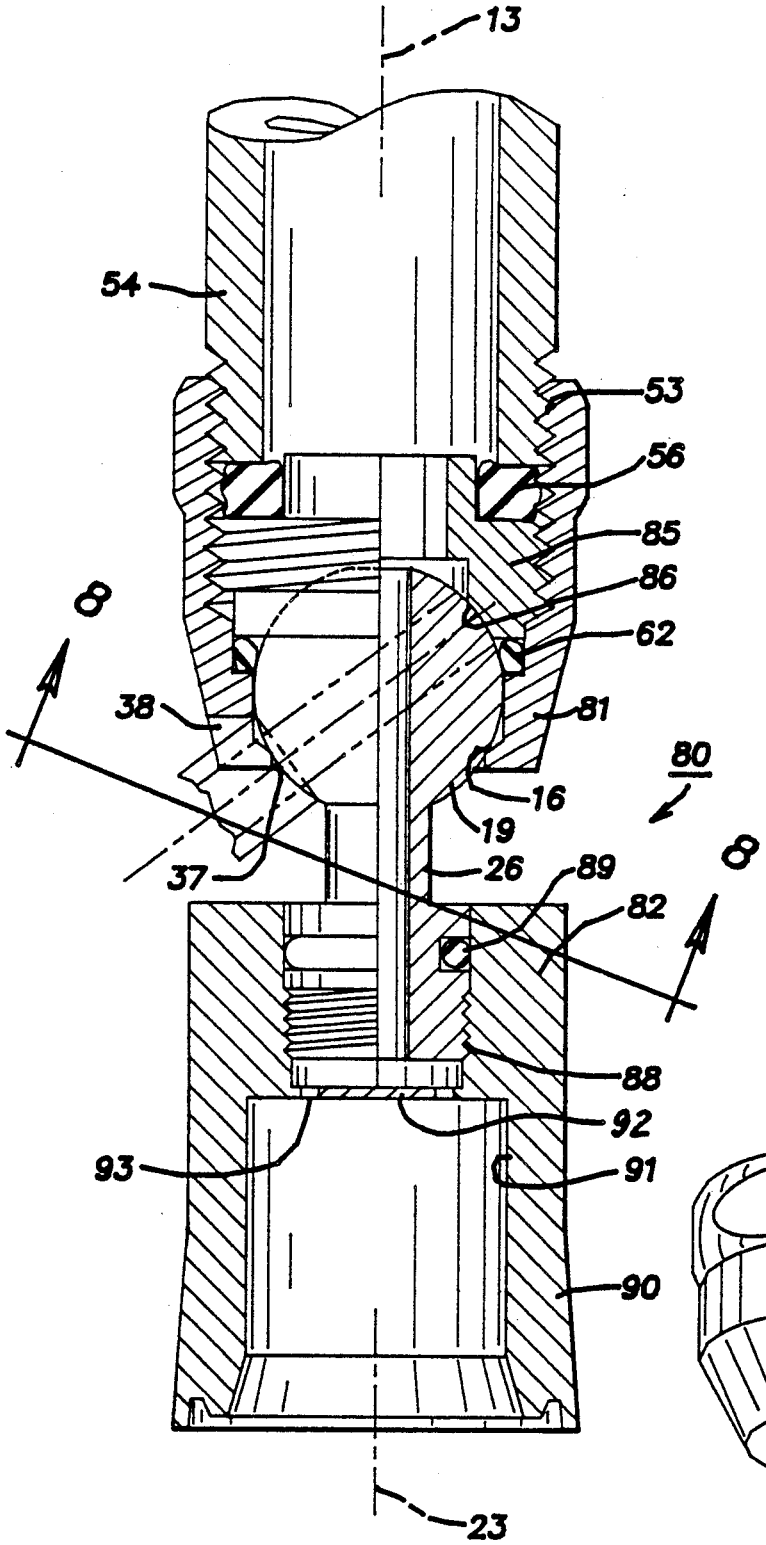
FIG. 7 is a longitudinal sectional view through a third embodiment of the invention.
Figure 8:
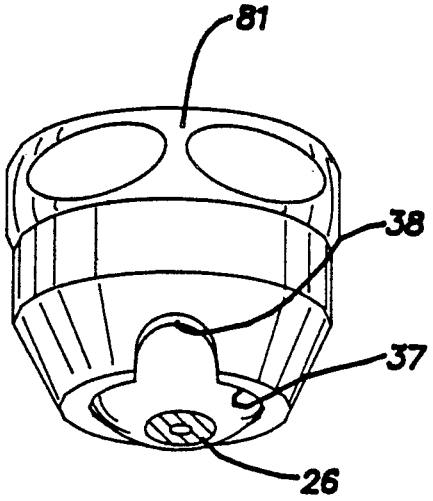
FIG. 8 is a sectional view on line 8—8 of FIG. 7.

FIGS. 7 and 8 illustrate a third embodiment of the invention of a valve nozzle assembly 80 with a female body 81 and a male body 82. The female body 81 may be substantially the same as the female body 51 of the second embodiment of FIGS. 5 and 6, and which forms a part of the socket 16 for the substantially circular cross section or ball member 19. Another part of the socket 16 is formed by an insert 85 which is threaded into the threaded inlet 53 of this female body which receives the supply conduit 54. The insert 85 again carries the gasket 56 to seal against the end of the supply conduit, and has the larger O-ring 62 as part of the gasket means for sealing against leakage. This construction of FIG. 7 may have the insert 85 forming part of the gasket means for sealing by being formed from a relatively hard plastics material, such as nylon. Alternatively, it may be of metal, such as brass. The annular shoulder 86 forming the inside diameter of the insert 85 may act as gasket means to seal against the ball 19. This inside diameter of the insert 85 again acts as a fluid inlet and may be hexagonally shaped for connection to a wrench for installation of the insert 85 into the threads 53. This permits proper tightening of the insert 85 irrespective of how tight the female body 81 is tightened onto the supply conduit 54.

The narrow neck 26 of the male body 82 may adjustably move within the enlarged adjustment opening 37 by approximately plus or minus 20 degrees in all directions relative to the axis 13 for full fluid flow conditions. The neck 26 may also move into the slot 38 which merges with the enlarged opening 37 to form a keyhole-shaped aperture as shown in FIG. 8. If the neck 26 is moved all the way into the slot 38, then the annular shoulder 86 is a part of the gasket means which will substantially shut off fluid flow for a trickle-flow condition. Alternatively, if the slot 38 is made just a little deeper, then the male body 82 may be rotated just a little more so that there is complete fluid shut-off.

The male body 82 has a threaded connection at 88 with an extension of the neck 26 which is sealed by an O-ring 89. The male body 82 has a nozzle extension 90 with an internal bore 91 which terminates in a wall 92 having apertures 93 off the axis 23. Again, the apertures 93 may be disposed on a reference circle coaxial with the axis 23, but displaced therefrom to provide aerated water, as in the embodiments of FIGS. 5 and 6. The embodiment of FIG. 7 has the same features as the embodiment of FIGS. 5 and 6, but may be considered to be preferred because it has only seven parts rather than 11 parts, for a saving of material and a saving of manufacturing and assembly time. The bodies 81 and 82 may be made of metal, such as brass or chrome-plated brass, or may be made of other material such as hard plastics.

Figure 9:
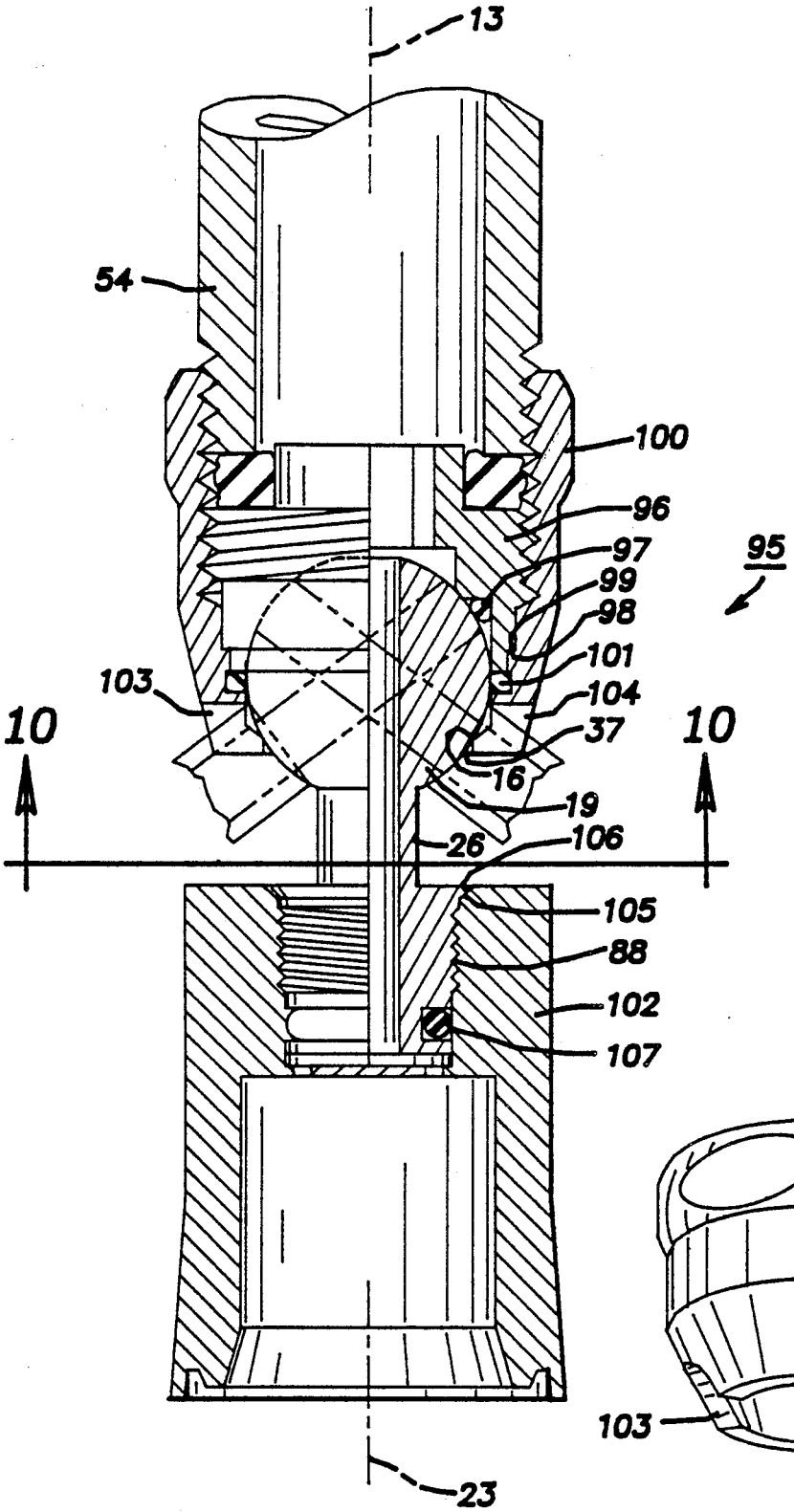
FIG. 9 is a longitudinal, sectional view through a fourth embodiment of the invention.
Figure 10:
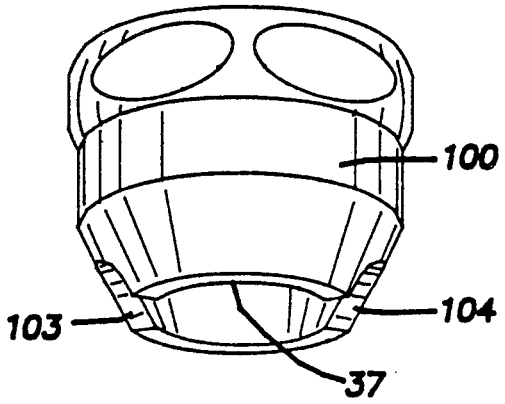
FIG. 10 is a sectional view on line 10—10 of FIG. 9, with the ball removed.

FIGS. 9 and 10 illustrate a fourth embodiment of the invention in a valve nozzle assembly 95. This embodiment has many parts the same as in the embodiment of FIGS. 7 and 8, and like parts have the same reference numeral. The difference includes the fact that the threaded insert 96 has a groove for an O-ring 97, and has a shoulder 98 abutting the shoulder 99 on a female body 100. Therefore, when this insert 96 is screwed into this female body or nut 100, there is a positive stop of the threading advancement of the insert 96 when the two shoulders 98 and 99 interengage. This has the advantage that it prevents the insert from being tightened so much that the ball 19 cannot turn easily in the socket 16.

Gasket means prevents leakage and includes the O-ring 97 and an O-ring 101 which is positioned in a slight groove in the female body 100 and trapped by the end of the threaded insert 96. This O-ring 101 not only prevents leakage when the male body 102 has the axis 23 aligned with the axis 13, but also when the male body 102 is swung to either side into a slot 103 or a slot 104 in the female body 100. Further, the O-ring 101 provides a certain amount of friction against movement of the ball 19 so that the male body 102 stays in the position to which it is adjusted.

The male body 102 also is slightly different from the male body 82 in the embodiment of FIGS. 7 and 8 in that a tapered shoulder 105 on the extension of the neck 26 coacts with a chamfer 106 on the male body 102. This provides a seal between the neck extension and the male body 102. An additional seal is provided by an optional O-ring 107 at the outer end of the threads 88. The two slots 103 and 104 provide the user with two different choices for a shut-off condition or trickle-flow condition, depending upon the depth of the slots 103 and 104. Each slot 103 and 104, together with the generally circular opening 37, make a slotted opening which may be considered a keyhole-shaped aperture.

All four embodiments disclose a valve nozzle assembly wherein the nozzle may be adjusted to a considerable range of movements shown as 40 degrees or plus or minus 20 degrees relative to the female body axis 13, and this is with the neck 26 inside the enlarged adjustment opening 37. Additionally, the valve nozzle assembly incorporates the shut-off condition or a substantial shut-off condition in a first position of the assembly such as shown in FIGS. 2 and 6, with the narrow neck in the slot 38. Accordingly, the entire assembly may be used in many different applications, either as a misting nozzle or water spray nozzle, a shower head, or a nozzle at the end of a garden hose. Also, it may be used on the end of a wand of an insecticide sprayer, for example, wherein adjustability is desired so that one may spray either the upper or lower surfaces of leafed branches of a shrub, for example. In all of these spray or mist nozzle applications, a shut-off or substantial shut-off condition is achieved by the keyhole-shaped slotted opening, all without requiring any extra valve parts.

The present disclosure includes that contained in the appended claims, as well as that of the foregoing description. Although this invention has been described in its preferred form with a certain degree of particularity, it is understood that the present disclosure of the preferred form has been made only by way of example and that numerous changes in the details of construction and the combination and arrangement of parts may be resorted to without departing from the spirit and the scope of the invention as hereinafter claimed.

What is claimed is:

1. A valve nozzle assembly comprising, in combination:

a female body having a first longitudinal axis and a generally longitudinal first conduit;

a male body having a second longitudinal axis and a generally longitudinal second conduit;

a socket in said female body;

a substantially circular cross section on said male body for cooperation with said socket, with said first and second conduits adapted to be in communication;

said male body having a narrow neck adjacent said socket;

a nozzle mounted in one of said bodies;

gasket means in one of said bodies and surrounding the conduit therein for sealing between said socket and said circular cross section male body;

said narrow neck having a first transverse dimension;

said socket having an opening larger than and receiving said neck for permitting angular adjustment of said nozzle for a preset number of degrees relative to said first longitudinal axis;

a recess in said socket extending along a diametral plane and merging with said larger socket opening to form a recessed opening having a width sufficient to receive said neck for permitting said nozzle to be rotated beyond said preset number of degrees between first and second positions so that said first conduit in one of said positions is substantially sealed from communication with said second conduit by said gasket means for a shut-off valve or trickle-flow condition of said valve nozzle assembly; the other of said positions establishing fluid communication between said conduits for establishing fluid flow through said nozzle; and said first and second longitudinal conduits having cross-sectional dimensions sufficient to maintain substantially full fluid flow in the other of said positions while providing angular adjustment of the nozzle up to said preset number of degrees in all directions relative to the axis of said other of said bodies.

2. A valve nozzle assembly as set forth in claim 1, wherein said female body is the fluid inlet and said nozzle is mounted in said male body.

3. A valve nozzle assembly as set forth in claim 1, wherein said gasket means includes an O-ring.

4. A valve nozzle assembly as set forth in claim 1, wherein said substantially circular cross section on said male body is a partial ball.

5. A valve nozzle assembly as set forth in claim 4, wherein said recess extends partially around the circumference of said ball.

6. A valve nozzle assembly as set forth in claim 1, wherein said other of said bodies is the fluid inlet.

7. A valve nozzle assembly as set forth in claim 1, wherein said socket comprises first and second coaxially interthreaded parts to secure said male body therein.

8. A valve nozzle assembly as set forth in claim 1, wherein said socket is a two-piece construction.

9. A valve nozzle assembly as set forth in claim 8, wherein said two pieces of said socket have a threaded interconnection.

10. A valve nozzle assembly as set forth in claim 1, including a retainer as part of said socket to secure said male body therein, and said retainer having a coaxial threaded connection with said female body.

11. A valve nozzle assembly as set forth in claim 10, including interengaging shoulders on said threaded retainer and said female body to establish a positive stop for the threaded connection.

12. The valve nozzle assembly as set forth in claim 1, wherein the preset number of degrees is in the order of 20 degrees for which said neck may move within said socket and said neck may be rotated at approximately 45 degrees between said first and second positions in order to create a shut-off or trickle-flow condition.

13. A nozzle assembly having a partially circular male body in a socket of a female body so that conduits in each of said bodies may be in fluid communication, a nozzle mounted in one of said bodies, gasket means for sealing between the socket and the male body, and said socket having an adjustment opening larger than and receiving an extending neck on said male body for permitting angular adjustment of said nozzle for a preset number of degrees relative to the axis of the other of said bodies;

characterized in that a recess is provided in said socket extending along a diametral plane and merging with said adjustment opening to form a recessed opening having a width sufficient to receive said neck for permitting said nozzle to be rotated beyond the preset number of degrees relative to said other of said bodies between first and second positions;

said first position establishing said conduits substantially sealed from communication by said gasket for no more than a trickle-flow condition of said nozzle assembly; and said second position being with said neck in said socket adjustment opening and said conduits being of a size for establishing substantially full fluid flow throughout said angular adjustment of said nozzle beyond said preset number of degrees relative to the axis of said female body.

14. A nozzle assembly as set forth in claim 13, wherein said male body is a partial ball.

15. A nozzle assembly as set forth in claim 14, wherein said recess extends partially around the circumference of said partial ball.

16. A nozzle assembly as set forth in claim 13, wherein said slot is dimensioned to establish a change from full fluid communication to substantially zero fluid communication with a movement of said nozzle from said second to said first position.

17. A nozzle assembly as set forth in claim 13, wherein said recess permits rotation of said nozzle by approximately 90 degrees relative to the other of said bodies.

18. A nozzle assembly as set forth in claim 13, wherein said gasket means is annular and surrounds the conduit in said other body, and said first position establishes the conduit in said one body positioned outside the annulus of said gasket means for a flow shut-off condition.

19. A nozzle assembly as set forth in claim 13, wherein said nozzle is mounted in said male body; and said male body being in two pieces interthreaded.

20. A nozzle assembly as set forth in claim 19, wherein the junction between said two pieces of said male body is part of said nozzle to spread the flow of liquid.

21. A valve nozzle assembly comprising, in combination:

a female body having a first longitudinal axis and a generally longitudinal first conduit;

a male body having a second longitudinal axis and a generally longitudinal second conduit;

a socket in said female body;

a substantially circular cross section on said male body for limited pivoting cooperation with said socket, with said first and second conduits adapted to be in communication;

a nozzle mounted in one of said bodies;

first gasket means in the other of said bodies and surrounding the conduit therein for sealing between said socket and said circular cross section male body;

a retainer as part of said socket to secure said male body therein;

said retainer having a threaded connection coaxial with said female body;

second gasket means bearing against said threaded retainer and adapted to seal against a fluid supply conduit; and the tightening of said threaded retainer as part of said socket compressing said first gasket means independent of any tightening of said female body onto a fluid supply conduit.

22. A valve nozzle assembly as set forth in claim 21, including a shoulder acting between said threaded retainer and said socket to establish a positive stop therebetween.

23. A valve nozzle assembly as set forth in claim 21, including interengaging shoulders on said threaded retainer and said female body to establish a positive stop for the threaded connection.

24. A valve nozzle assembly comprising, in combination:

a female body having a first longitudinal axis and a generally longitudinal first conduit;

a male body having a second longitudinal axis and a generally longitudinal second conduit;

a socket in said female body;

a substantially circular cross section on said male body for limited pivoting cooperation with said socket, with said first and second conduits adapted to be in communication;

a nozzle mounted in one of said bodies;

first gasket means in the other of said bodies and surrounding the conduit therein for sealing between said socket and said circular cross section male body;

a retainer as part of said socket to secure said male body therein:

said retainer having a threaded connection with said female body;

second gasket means bearing against said threaded retainer and adapted to seal against a fluid supply conduit; and the tightening of said female body onto a fluid supply conduit being independent of the compression of said first gasket means between said male body and said socket.

25. A valve nozzle assembly comprising, in combination:

a female body having a first longitudinal axis and a generally longitudinal first conduit;

a male body having a second longitudinal axis and a generally longitudinal second conduit;

a socket in said female body;

a substantially circular cross section on said male body for limited pivoting cooperation with said socket, with said first and second conduits adapted to be in communication;

a nozzle mounted in one of said bodies;

first gasket means in the other of said bodies and surrounding the conduit therein for sealing between said socket and said circular cross section male body;

a retainer as part of said socket to secure said male body therein:

said retainer having a threaded connection with said female body;

said nozzle having a threaded mounting on said one of said bodies;

a threaded portion on the other of said bodies adapted to receive a fluid supply conduit; and the tightening of said threaded retainer as part of said socket compressing said first gasket means independent of any tightening of said nozzle and the fluid supply conduit.

* * * * *